US007499062B2

(12) United States Patent
Yamada

(10) Patent No.: US 7,499,062 B2
(45) Date of Patent: Mar. 3, 2009

(54) IMAGE DISPLAY METHOD AND IMAGE DISPLAY APPARATUS FOR DISPLAYING A GRADATION BY A SUBFIELD METHOD

(75) Inventor: Kazuhiro Yamada, Takatsuki (JP)

(73) Assignee: Panasonic Corporation, Osaka (JP)

( * ) Notice: Subject to any disclaimer, the term of this patent is extended or adjusted under 35 U.S.C. 154(b) by 517 days.

(21) Appl. No.: 10/515,526

(22) PCT Filed: Dec. 26, 2003

(86) PCT No.: PCT/JP03/17018

§ 371 (c)(1),
(2), (4) Date: Nov. 23, 2004

(87) PCT Pub. No.: WO2005/066926

PCT Pub. Date: Jul. 21, 2005

(65) Prior Publication Data

US 2006/0017744 A1 Jan. 26, 2006

(30) Foreign Application Priority Data

Oct. 11, 2002 (JP) ..... 2002-298789

(51) Int. Cl.
*G09G 5/00* (2006.01)

(52) U.S. Cl. ..... 345/690; 345/63; 345/89

(58) Field of Classification Search ..... 345/60, 345/63, 204, 693, 596, 89, 690; 315/169.4; 348/797

See application file for complete search history.

(56) References Cited

U.S. PATENT DOCUMENTS 6,965,358 B1 * 11/2005 Kasahara et al. ..... 345/63
2001/0028347 A1 * 10/2001 Kawahara et al. ..... 345/204
2003/0146910 A1 8/2003 Tokunaga

FOREIGN PATENT DOCUMENTS

JP 11-212517 A 8/1999
JP 11-231827 A 8/1999
JP 2000-20024 A 1/2000
JP 2000-276100 A 10/2000
JP 2002-023692 A 1/2002

(Continued)

OTHER PUBLICATIONS

Japanese International Search Report for PCT/JP2003/17018, dated Apr. 20, 2004.

Hoppenbrouwers J J L et al., 100-Hz Video Upconversion in Plasma Displays, 2002 SID International Symposium Digest of Technical Papers, Boston, MA, May 21-23, 2002, SID International Symposium Digest of Technical Papers, San Jose, CA, SID, US, vol. 33, May 2, 2002 pp. 922-925.

(Continued)

*Primary Examiner*—Abbas I Abdulselam
(74) *Attorney, Agent, or Firm*—RatnerPrestia

(57) ABSTRACT

An image display method and image display apparatus reduce dynamic false contours with sufficient gradations maintained even in a portion where large dynamic false contours occur. The image display method and image display apparatus convert a gradation level of a non-target pixel to a display-use gradation level to display. For a target pixel, a first diffusion process, in which the gradation level is converted to a first gradation level, which is an average of (n) (n is an integer of two or greater) levels of gradations selected from the display-use gradation levels, and the first gradation level is averaged spatially and/or chronologically using the (n) levels of gradations, suppressing dynamic false contours with sufficient gradations maintained.

12 Claims, 14 Drawing Sheets

FOREIGN PATENT DOCUMENTS

| | | | |
|---|---|---|---|
| JP | 2002-82649 | A | 3/2002 |
| JP | 2003-228319 | A | 8/2003 |
| WO | WO 00/43979 | | 7/2000 |
| WO | WO 03/091975 | A1 | 11/2003 |

OTHER PUBLICATIONS

Supplementary European Search Report for Application No. EP 03 78 2952 dated May 8, 2008.

* cited by examiner

FIG. 2A

| Subfield | 1 | 2 | 3 | 4 | 5 | 6 | 7 | 8 | 9 | 10 |
|---|---|---|---|---|---|---|---|---|---|---|
| Luminance weight | 1 | 2 | 4 | 8 | 16 | 25 | 34 | 44 | 55 | 66 |
| Gradation level | | | | | | | | | | |
| 0 | | | | | | | | | | |
| 1 | • | | | | | | | | | |
| 2 | | • | | | | | | | | |
| 3 | • | • | | | | | | | | |
| 5 | • | | • | | | | | | | |
| 6 | | • | • | | | | | | | |
| 7 | • | • | • | | | | | | | |
| 11 | • | • | | • | | | | | | |
| 13 | • | | • | • | | | | | | |
| 14 | | • | • | • | | | | | | |
| 15 | • | • | • | • | | | | | | |
| 23 | • | • | • | | • | | | | | |
| 27 | • | • | | • | • | | | | | |
| 29 | • | | • | • | • | | | | | |
| 30 | | • | • | • | • | | | | | |
| 31 | • | • | • | • | • | | | | | |
| 40 | • | • | • | • | | • | | | | |
| 48 | • | • | • | | • | • | | | | |
| 52 | • | • | | • | • | • | | | | |
| 54 | • | | • | • | • | • | | | | |
| 55 | | • | • | • | • | • | | | | |
| 56 | • | • | • | • | • | • | | | | |
| 65 | • | • | • | • | • | | • | | | |
| 74 | • | • | • | • | | • | • | | | |
| 82 | • | • | • | | • | • | • | | | |
| 86 | • | • | | • | • | • | • | | | |
| 88 | • | | • | • | • | • | • | | | |
| 89 | | • | • | • | • | • | • | | | |

FIG. 2B

| Subfield | 1 | 2 | 3 | 4 | 5 | 6 | 7 | 8 | 9 | 10 |
|---|---|---|---|---|---|---|---|---|---|---|
| Luminance weight | 1 | 2 | 4 | 8 | 16 | 25 | 34 | 44 | 55 | 66 |
| Gradation level | | | | | | | | | | |
| 90 | • | • | • | • | • | • | • | | | |
| 100 | • | • | • | • | • | • | | • | | |
| 109 | • | • | • | • | • | | • | • | | |
| 118 | • | • | • | • | | • | • | • | | |
| 126 | • | • | • | | • | • | • | • | | |
| 130 | • | • | | • | • | • | • | • | | |
| 132 | • | | • | • | • | • | • | • | | |
| 133 | | • | • | • | • | • | • | • | | |
| 134 | • | • | • | • | • | • | • | • | | |
| 145 | • | • | • | • | • | • | • | | • | |
| 155 | • | • | • | • | • | • | | • | • | |
| 164 | • | • | • | • | • | | • | • | • | |
| 173 | • | • | • | • | | • | • | • | • | |
| 181 | • | • | • | | • | • | • | • | • | |
| 185 | • | • | | • | • | • | • | • | • | |
| 187 | • | | • | • | • | • | • | • | • | |
| 188 | | • | • | • | • | • | • | • | • | |
| 189 | • | • | • | • | • | • | • | • | • | |
| 200 | • | • | • | • | • | • | • | • | | • |
| 211 | • | • | • | • | • | • | • | | • | • |
| 221 | • | • | • | • | • | • | | • | • | • |
| 230 | • | • | • | • | • | | • | • | • | • |
| 239 | • | • | • | • | | • | • | • | • | • |
| 247 | • | • | • | | • | • | • | • | • | • |
| 251 | • | • | | • | • | • | • | • | • | • |
| 253 | • | | • | • | • | • | • | • | • | • |
| 254 | | • | • | • | • | • | • | • | • | • |
| 255 | • | • | • | • | • | • | • | • | • | • |

FIG. 3

| Subfield | 1 | 2 | 3 | 4 | 5 | 6 | 7 | 8 | 9 | 10 |
|---|---|---|---|---|---|---|---|---|---|---|
| Luminance weight | 1 | 2 | 4 | 8 | 16 | 25 | 34 | 44 | 55 | 66 |
| Gradation level | | | | | | | | | | |
| 31 | • | • | • | • | • | | | | | |
| 40 | • | • | • | • | | • | | | | |
| 48 | • | • | • | | • | • | | | | |
| 52 | • | • | | • | • | • | | | | |
| 54 | • | | • | • | • | • | | | | |
| 55 | | • | • | • | • | • | | | | |
| 56 | • | • | • | • | • | • | | | | |

FIG. 5

| First LUT | Amount to be added | | | | First LUT | Amount to be added | | | |
|---|---|---|---|---|---|---|---|---|---|
| First gradation level | d1 | d2 | d3 | d4 | First gradation level | d1 | d2 | d3 | d4 |
| 0 | 0 | 0 | 0 | 0 | 92 | -10 | -4 | -2 | 17 |
| 1 | -1 | -1 | 0 | 2 | 98 | -12 | -9 | 2 | 20 |
| 2 | -2 | -2 | 0 | 3 | 103 | -15 | -13 | 6 | 23 |
| 3 | -3 | -2 | 0 | 3 | 109 | -20 | -9 | 9 | 21 |
| 4 | -4 | -2 | 1 | 3 | 114 | -24 | -5 | 12 | 18 |
| 5 | -4 | -2 | 1 | 6 | 120 | -20 | -2 | 10 | 13 |
| 7 | -5 | -2 | 0 | 6 | 125 | -16 | 1 | 7 | 9 |
| 9 | -6 | -3 | 2 | 5 | 132 | -14 | -2 | 1 | 13 |
| 10 | -5 | -3 | 3 | 5 | 137 | -11 | -5 | -3 | 18 |
| 14 | -8 | -3 | 0 | 9 | 143 | -13 | -10 | 2 | 21 |
| 16 | -9 | -3 | -1 | 11 | 149 | -17 | -15 | 6 | 24 |
| 19 | -8 | -5 | 4 | 10 | 156 | -23 | -11 | 8 | 25 |
| 21 | -8 | -6 | 6 | 9 | 162 | -28 | -7 | 11 | 23 |
| 24 | -10 | -1 | 5 | 7 | 169 | -24 | -5 | 12 | 18 |
| 28 | -13 | -1 | 2 | 12 | 175 | -20 | -2 | 10 | 13 |
| 33 | -10 | -4 | -2 | 15 | 180 | -16 | 1 | 7 | 9 |
| 37 | -10 | -7 | 3 | 15 | 187 | -14 | -2 | 1 | 13 |
| 41 | -12 | -10 | 7 | 13 | 192 | -11 | -5 | -3 | 19 |
| 44 | -14 | -4 | 8 | 11 | 199 | -14 | -11 | 1 | 22 |
| 47 | -16 | 1 | 7 | 9 | 204 | -17 | -15 | 7 | 26 |
| 53 | -13 | -1 | 2 | 12 | 212 | -24 | -12 | 9 | 27 |
| 58 | -10 | -4 | -2 | 16 | 219 | -30 | -8 | 11 | 28 |
| 64 | -12 | -9 | 1 | 18 | 228 | -28 | -7 | 11 | 23 |
| 68 | -14 | -12 | 6 | 18 | 235 | -24 | -5 | 12 | 18 |
| 73 | -18 | -8 | 9 | 15 | 241 | -20 | -2 | 10 | 13 |
| 76 | -20 | -2 | 10 | 13 | 246 | -16 | 1 | 7 | 9 |
| 81 | -16 | 1 | 7 | 9 | 250 | -11 | 1 | 4 | 5 |
| 87 | -13 | -1 | 2 | 13 | 253 | -6 | 0 | 2 | 2 |

FIG. 6

| Second LUT | Amount to be added | | | | Second LUT | Amount to be added | | | |
|---|---|---|---|---|---|---|---|---|---|
| Display-use gradation level | d1 | d2 | d3 | d4 | Display-use gradation level | d1 | d2 | d3 | d4 |
| 0 | 0 | 0 | 0 | 0 | 90 | 0 | 0 | 0 | 0 |
| 1 | 0 | 0 | 0 | 0 | 100 | 0 | 0 | 0 | 0 |
| 2 | 0 | 0 | 0 | 0 | 109 | 0 | 0 | 0 | 0 |
| 3 | 0 | 0 | 0 | 0 | 118 | 0 | 0 | 0 | 0 |
| 5 | 0 | 0 | 0 | 0 | 126 | 0 | 0 | 0 | 0 |
| 6 | 0 | 0 | 0 | 0 | 130 | 0 | 0 | 0 | 0 |
| 7 | 0 | 0 | 0 | 0 | 132 | 0 | 0 | 0 | 0 |
| 11 | 0 | 0 | 0 | 0 | 133 | 0 | 0 | 0 | 0 |
| 13 | 0 | 0 | 0 | 0 | 134 | 0 | 0 | 0 | 0 |
| 14 | 0 | 0 | 0 | 0 | 145 | 0 | 0 | 0 | 0 |
| 15 | 0 | 0 | 0 | 0 | 155 | 0 | 0 | 0 | 0 |
| 23 | 0 | 0 | 0 | 0 | 164 | 0 | 0 | 0 | 0 |
| 27 | 0 | 0 | 0 | 0 | 173 | 0 | 0 | 0 | 0 |
| 29 | 0 | 0 | 0 | 0 | 181 | 0 | 0 | 0 | 0 |
| 30 | 0 | 0 | 0 | 0 | 185 | 0 | 0 | 0 | 0 |
| 31 | 0 | 0 | 0 | 0 | 187 | 0 | 0 | 0 | 0 |
| 40 | 0 | 0 | 0 | 0 | 188 | 0 | 0 | 0 | 0 |
| 48 | 0 | 0 | 0 | 0 | 189 | 0 | 0 | 0 | 0 |
| 52 | 0 | 0 | 0 | 0 | 200 | 0 | 0 | 0 | 0 |
| 54 | 0 | 0 | 0 | 0 | 211 | 0 | 0 | 0 | 0 |
| 55 | 0 | 0 | 0 | 0 | 221 | 0 | 0 | 0 | 0 |
| 56 | 0 | 0 | 0 | 0 | 230 | 0 | 0 | 0 | 0 |
| 65 | 0 | 0 | 0 | 0 | 239 | 0 | 0 | 0 | 0 |
| 74 | 0 | 0 | 0 | 0 | 247 | 0 | 0 | 0 | 0 |
| 82 | 0 | 0 | 0 | 0 | 251 | 0 | 0 | 0 | 0 |
| 86 | 0 | 0 | 0 | 0 | 253 | 0 | 0 | 0 | 0 |
| 88 | 0 | 0 | 0 | 0 | 254 | 0 | 0 | 0 | 0 |
| 89 | 0 | 0 | 0 | 0 | 255 | 0 | 0 | 0 | 0 |

FIG. 9A

| | |
|---|---|
| d1 | d3 |
| d4 | d2 |

FIG. 9B

| | | | | | | | | | | | | | |
|---|---|---|---|---|---|---|---|---|---|---|---|---|---|
| d1 | d3 | d1 | d3 | d1 | d3 | d1 | d3 | d1 | d3 | d1 | d3 | d1 | d3 |
| d4 | d2 | d4 | d2 | d4 | d2 | d4 | d2 | d4 | d2 | d4 | d2 | d4 | d2 |
| d1 | d3 | d1 | d3 | d1 | d3 | d1 | d3 | d1 | d3 | d1 | d3 | d1 | d3 |
| d4 | d2 | d4 | d2 | d4 | d2 | d4 | d2 | d4 | d2 | d4 | d2 | d4 | d2 |
| d1 | d3 | d1 | d3 | d1 | d3 | d1 | d3 | d1 | d3 | d1 | d3 | d1 | d3 |
| d4 | d2 | d4 | d2 | d4 | d2 | d4 | d2 | d4 | d2 | d4 | d2 | d4 | d2 |
| d1 | d3 | d1 | d3 | d1 | d3 | d1 | d3 | d1 | d3 | d1 | d3 | d1 | d3 |
| d4 | d2 | d4 | d2 | d4 | d2 | d4 | d2 | d4 | d2 | d4 | d2 | d4 | d2 |
| d1 | d3 | d1 | d3 | d1 | d3 | d1 | d3 | d1 | d3 | d1 | d3 | d1 | d3 |
| d4 | d2 | d4 | d2 | d4 | d2 | d4 | d2 | d4 | d2 | d4 | d2 | d4 | d2 |
| d1 | d3 | d1 | d3 | d1 | d3 | d1 | d3 | d1 | d3 | d1 | d3 | d1 | d3 |
| d4 | d2 | d4 | d2 | d4 | d2 | d4 | d2 | d4 | d2 | d4 | d2 | d4 | d2 |

FIG. 13

| Subfield / Luminance weight / Gradation level | 1 | 2 | 3 | 4 | 5 | 6 | 7 | 8 |
|---|---|---|---|---|---|---|---|---|
| | 1 | 2 | 4 | 8 | 16 | 32 | 64 | 128 |
| : | | | | | | | | |
| 22 | | • | • | | • | | | |
| 23 | • | • | • | | • | | | |
| 24 | | | | • | • | | | |
| 25 | • | | | • | • | | | |
| 26 | | • | | • | • | | | |
| 27 | • | • | | • | • | | | |
| 28 | | | • | • | • | | | |
| 29 | • | | • | • | • | | | |
| 30 | | • | • | • | • | | | |
| 31 | • | • | • | • | • | | | |
| 32 | | | | | | • | | |
| 33 | • | | | | | • | | |
| 34 | | • | | | | • | | |
| 35 | • | • | | | | • | | |
| 36 | | | • | | | • | | |
| 37 | • | | • | | | • | | |
| 38 | | • | • | | | • | | |
| 39 | • | • | • | | | • | | |
| : | | | | | | | | |

IMAGE DISPLAY METHOD AND IMAGE DISPLAY APPARATUS FOR DISPLAYING A GRADATION BY A SUBFIELD METHOD

THIS APPLICATION IS A U.S. NATIONAL PHASE APPLICATION OF PCT INTERNATIONAL APPLICATION PCT/JP2003/017018.

TECHNICAL FIELD

The present invention relates to an image display method and image display apparatus such as a plasma display panel (hereinafter abbreviated as "PDP") or digital mirror device (DMD), which displays multilevel gradations by dividing a single image field into a plurality of subfields.

BACKGROUND ART

For image display in an image display apparatus such as a PDP, that performs binary light emission, a so-called subfield method is used, where motion pictures with intermediate gradations are presented by superimposing chronologically a plurality of binary images each weighted.

In the subfield method, a single field is divided into a plurality of subfields, where each subfield weighted with luminance. The luminance weight for a subfield corresponds to the amount of light emission when the subfield is lighted. In other words, each subfield has a predetermined number of light-emission as its luminance weight, where the sum of the luminance weights of light-emitting subfield corresponds to a luminance gradation level to be displayed.

FIG. 10 illustrates a single field divided into eight subfields (SF1, SF2, . . . , and SF8). In FIG. 10, respective subfields have luminance weights 1, 2, 4, 8, 16, 32, 64, and 128. Each subfield has: setup period T1 for a preliminary discharge; address period T2 for an address discharge that sets to emitted or non-emitted for each pixel; and sustain period T3 during which pixels with emitted data being written by a discharge are made to emit light by generating a sustain discharge all at once. Here, light-emission of subfields occurs from SF1 through SF8 sequentially.

In the example shown in FIG. 10, light-emitting these subfields in various combinations represents gradations of 256 levels 0 through 255. For example, emitting SF1, SF2, and SF3 represents the gradation level 7 (1+2+4=7); SF1, SF3, and SF5, the gradation level 21 (1+4+16=21).

In this way, the subfield method represents multilevel gradations by dividing a single field into a plurality of subfields, and by selecting and light-emitting subfields from among a plurality of subfields to achieve a desired gradation.

In such a display apparatus that uses the subfield method for multilevel gradation display, it is known that false contour lines (hereinafter abbreviated as "dynamic false contours") appear while displaying motion pictures. Next, a description is made for the dynamic false contours.

FIG. 11 illustrates how image pattern X horizontally moves on the screen of PDP 33. For example, the following situation is assumed. That is, one field is divided into subfields weighted as (1, 2, 4, 8, 16, 32, 64, and 128) and as shown in FIG. 11, image pattern X horizontally moves on the screen of PDP 33 b two pixels per one field. Image pattern X includes pixels P1 and P2, both with the gradation level "127," and pixels P3 and P4, adjacent to pixels P1 and P2, both with the gradation level "128." FIG. 12 is a view in which image pattern X is developed to subfields.

In FIG. 12, the lateral direction represents a horizontal direction on the screen of PDP 33, and the vertical direction represents a time direction. Further, the hatched areas show emitting subfields, and the non-hatched areas show non-emitting subfields.

In FIG. 12, when image pattern X remains stationary, the pixel-original gradation can be perceived because a viewer's sight line does not move (A-A' in the figure). However, if image pattern X moves horizontally as shown in FIG. 11, a viewer's sight line follows image pattern X to move in directions B-B' or C-C' in FIG. 12. When the sight line moves in direction B-B', the viewer sees SF1 through SF5 of pixel P4, SF6 and SF7 of pixel P3, and SF8 of pixel P2. In FIG. 12, these subfields, all non-emitting, end up in time-integrated, the gradation level 0 being viewed. Meanwhile, when the sight line moves in direction C-C', the viewer sees SF1 through SF5 of pixel P1, SF6 and SF7 of pixel P2, and SF8 of pixel P3. In FIG. 12, these subfields, all light-emitting, end up in time-integrated, the gradation level 255 being viewed. In either case, where its gradation level largely differs from its original gradation level (127 or 128), the difference is perceived as false contour lines, which is deterioration in image quality. This phenomenon, dynamic false contours, occurs when pixels lie next to each other with such gradations that the pattern of emitting subfields largely changes on the contrary to its small change in gradation. In the example of the subfields weighted as described above, for adjacent pixels with luminance gradation levels 63 and 64, 191 and 192, and the like, dynamic false contours are notably observed also.

A description is made for a conventional method to suppress the dynamic false contours. First, convert the gradation level of an input image to a level at which dynamic false contours are unlikely occur, namely to a "predetermined gradation level" where the change in pattern of emitting subfields is small. Next, diffuse the difference between the converted gradation level and its pre-converted one, to the surrounding pixels. This interpolates the difference of the gradation levels caused by the conversion. If the difference is great between the gradation level of an input image and the "predetermined gradation level," convert to an "intermediate gradation level," which is between the gradation level of an input image and the "predetermined gradation level." Next, add the difference of gradation levels between the intermediate gradation level" and the "predetermined gradation level," to the "intermediate gradation level," or subtract from the "intermediate gradation level." Repeat the addition and subtraction alternately by dot, by line, and by field to present averagely "intermediate gradation levels." In this way, in addition to a "predetermined gradation level" at which dynamic false contours are unlikely to occur, using an "intermediate gradation level" suppresses dynamic false contours while preventing the number of gradation levels to be reduced.

However, the above-mentioned conventional method has the following problems. That is, if gradations have some gradient, and also a part where such a condition applies over such a plurality of pixels that they are well perceived visually, for example an unfocused part of the image, moves at a speed visually traceable, very large dynamic false contours are observed. Further, in order to suppress the dynamic false contours near a gradation level at which they occur, the number of gradation levels must be reduced, disabling the number to be sufficiently secured.

SUMMARY OF THE INVENTION

The present invention aims at implementing an image display method and image display apparatus that reduce dynamic false contours with sufficient gradations sustained even in a portion where dynamic false contours tend to occur.

The present invention is an image display method to display a gradation using the subfield method, wherein as a display-use gradation, a gradation where non-emitting subfields, with a luminance weight smaller than that of a emitted subfield with the maximum luminance weight, do not lie next each other, is used. Further, for a display region where an image does not move, or where the gradation level does not change monotonously, a gradation level to be displayed is converted to a display-use gradation to display an image. Meanwhile, for a display region where the image moves, and also the gradation level changes monotonously, a gradation level to be displayed is converted to a first gradation level, which is an average of (n) (where n is an integer of two or greater) levels of display-use gradations selected, and then a first diffusion process is performed, where (n) levels of display-use gradations are averaged spatially and/or chronologically to display an image.

Further, the present invention is an image display apparatus for displaying a gradation using the subfield method, including: a gradation converter, wherein as a display-use gradation, a gradation where non-emitting subfields, with a luminance weight smaller than that of a emitted subfield with the maximum luminance weight, do not lie next each other, is used. Further, for a display region where an image does not move or the gradation level does not change monotonously, a gradation level to be displayed is converted to a display-use gradation to display an image. Meanwhile, for a display region where the image moves and also the gradation level changes monotonously, a gradation level to be displayed is converted to a first gradation level, which is an average of (n) (where n is an integer of two or greater) levels of display-use gradations selected; and a first diffusion circuit for averaging (n) levels of display-use gradations spatially and/or chronologically.

BRIEF DESCRIPTION OF THE DRAWINGS

FIGS. 2A and 2B show combinations of display gradation levels and light-emitting conditions for each subfield when 10 subfields are used for 255-level gradation display according to one embodiment of the present invention.

FIG. 3 shows a part of FIG. 2A where gradation levels 31 through 56 are extracted.

FIG. 5 shows a first LUT included in a gradation converter according to one embodiment of the present invention.

FIG. 6 shows a second LUT included in the gradation converter according to one embodiment of the present invention.

FIGS. 9A and 9B shows a matrix with which a first diffusion process is performed in a first diffusing circuit according to one embodiment of the present invention.

FIG. 13 shows a case where gradation levels 22 through 39 are displayed with the eight subfields according to one embodiment of the present invention.

DETAILED DESCRIPTION OF PREFERRED EMBODIMENTS

Embodiment

Figure 1:
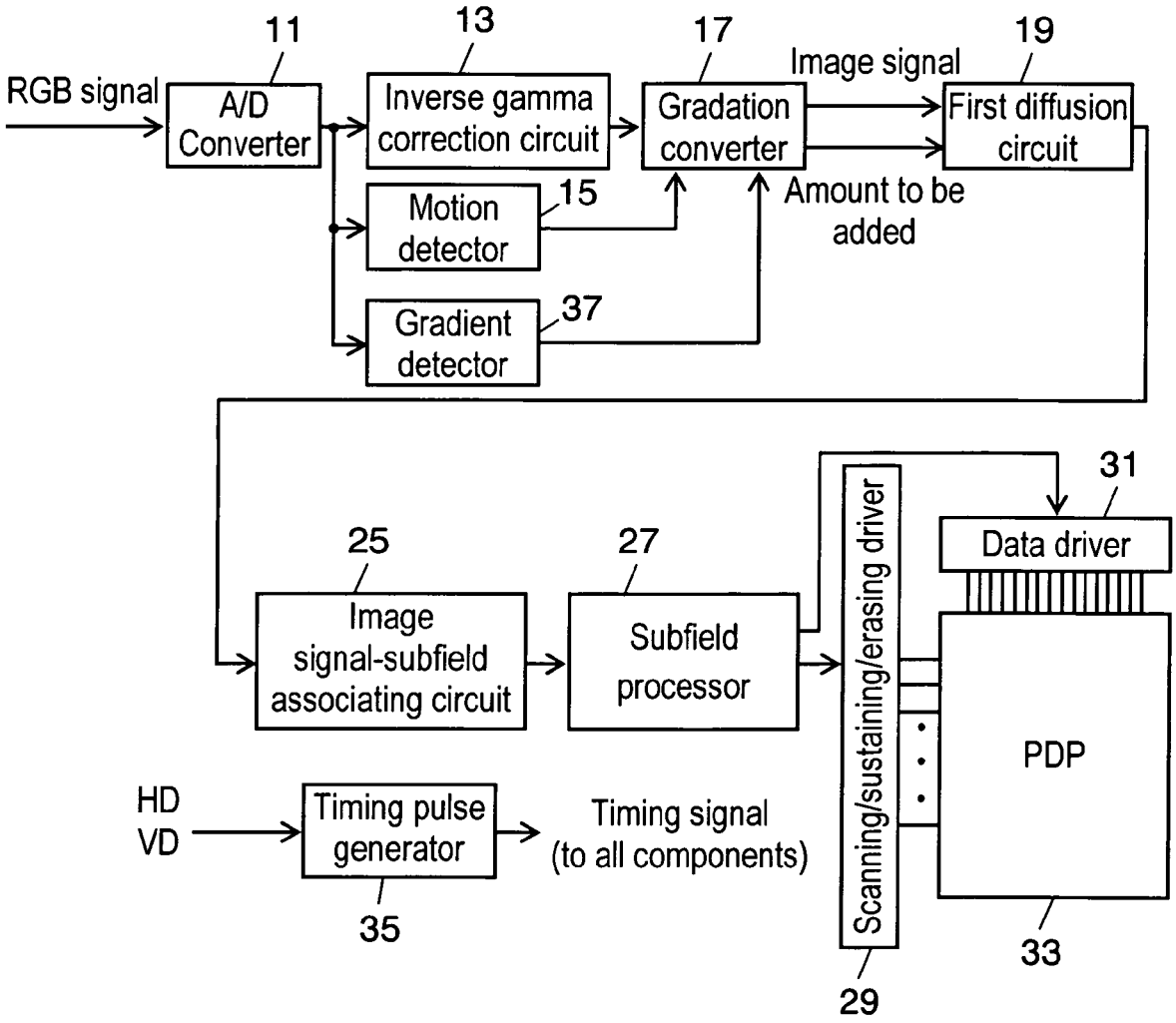
FIG. 1 is a schematic block diagram for illustrating an image display apparatus according to one embodiment of the present invention.

Hereinafter, one embodiment of the present invention is described referring to the drawings. In this embodiment, only one color is discussed for simplifying the description, however, R(red), G(.green), and B(blue) are also applicable.

FIG. 1 is a schematic block diagram for illustrating an image display apparatus (hereinafter abbreviated as an "display apparatus") according to one embodiment of the present invention. The display apparatus includes: A/D converter 11; inverse gamma correction circuit 13; motion detector 15; gradient detector 37; gradation converter 17; first diffusing circuit 19; image signal-subfield associating circuit 25; subfield processor 27; scanning-sustaining-erasing driver 29; data driver 31; PDP 33; and timing pulse generator 35.

In this case, PDP 33 is an display apparatus for displaying a gradation using the subfield method. In such a case, gradation levels to be displayed may be limited for stability in a discharge. This is because a discharge in PDP 33 is not independent among subfields, but it is influenced by the previous condition of subfields. The tendency of an address discharge to occur in a certain subfield depends on whether a sustain discharge has been made in the previous subfield or not. In other words, when a sustain discharge has been made in the previous subfield, an address discharge is likely to occur, and otherwise, an address discharge is unlikely to occur. This is because, when a sustain discharge has occurred in the previous subfield, a large amount of charged particles are emitted into the discharge space, and these particles become seeds for an address discharge in the next subfield. If an address discharge is unlikely to occur in a certain subfield, the probability that the subfield cannot emit light in the sustain period is increased. If such a case frequently occurs, the image quality largely deteriorates.

FIG. 13 illustrates a situation where a single field is divided into eight subfields (SF1, SF2, , and SF8), and gradation levels 22 through 39 are displayed with respective luminance weightings of 1, 2, 4, 8, 16, 32, 64, and 128. Further, a subfield shown with a solid dot "●" is a subfield to be light-emitted. In FIG. 13, at the gradation level 32, a sustain discharge does not occur in SF1 through SF5, and an address and a sustain discharges are made for the first time in SF6. In such a case, an address discharge is unlikely to occur in SF6 from the above-mentioned reason. In addition, this phenomenon is particularly prominent when the preliminary discharge period is reduced or omitted in order to lower the luminance level when displaying black aiming at a contrast improvement. This is because the independence among subfields further weakens.

Here, a method is presented in which the number of gradation levels is limited for preventing the above-mentioned failure in writing. FIGS. 2A and 2B show combinations of display gradation levels and a light-emitting condition for each subfield when 10 subfields are used for 255-level gradation display, where a single field period is divided into 10 subfields (SF1, SF2, , and SF10) with luminance weights of (1, 2, 4, 8, 16, 25, 34, 44, 55, and 66) respectively. In this case, a subfield shown with a solid dot "●" is a subfield to be light-emitted. In the example shown in FIGS. 2A and 2B, a sustain discharge is always made in a subfield immediately prior to a subfield without a sustain discharge for all gradation levels, and any non-emitted subfield does not lie next to another. Accordingly, the probability of failure in an address discharge can be well suppressed.

In this embodiment, therefore, a gradation level at which a stable discharge occurs, namely, a gradation level at which non-emitted subfields do not lie next to each other, for a luminance weight smaller than that of a emitted subfield with the maximum luminance weight, as shown in FIGS. 2A and 2B, is adopted as a "display-use gradation level."

In FIG. 1, PDP 33 is a display apparatus that performs binary control of light emission with its electrodes arranged in a matrix-like form. In this embodiment, as in the description for the conventional method, PDP 33 displays multilevel gradations using a plurality of respectively weighted subfields.

Timing pulse generator 35, based on horizontal (HD) and vertical (VD) synchronizing signals, generates timing signals (operating clock signals) and supplies them to all components in the display apparatus.

A/D converter 11 converts RGB signals having been input from analog to digital(hereinafter abbreviated as "A/D conversion").

A/D-converted RGB signals are inverse-gamma-corrected by inverse gamma correction circuit 13. In other words, because RGB signals have been sent with a gamma characteristic assuming display on a CRT display apparatus, the signals resume their original characteristic by inverse gamma correction.

Motion detector 15 detects a presence of a motion picture portion in A/D-converted RGB signals, and outputs "1" when a motion picture portion is detected and "0" otherwise. In this case, the difference in gradation levels of a pixel between adjacent two fields is calculated, and when the absolute value of the difference exceeds a predetermined value, the pixel is regarded as a motion picture portion. As a predetermined value in this embodiment, a value between 10 and 30 is appropriate when the sum of the weights for all the subfields is 255.

Gradient detector 37 detects the presence of a gradient part in A/D converted RGB signals, and outputs "1" when a gradient part is detected and "0" otherwise. In this embodiment, for (m) (where m is an integer of two or greater) pixels horizontally or vertically continuous, a part where its gradation level is increasing or decreasing monotonously is regarded as a display region with its gradation level monotonously changing, namely a gradient part. In addition, in this embodiment, the value m is-set to the number of pixels so that the length or width ranges between 3 mm and 15 mm inclusive, which corresponds to a breadth of 42-inch PDP display screen between 0.3% and 1.5%. If the value m is set to one smaller than the above-mentioned, such a minute region that dynamic false contours are not observed is detected, and if greater, on the contrary, such a region is not detected.

Next, the output from motion detector 15 and gradient detector 37, and inverse-gamma-corrected RGB signals are input to gradation converter 17. Then, a process is made to suppress dynamic false contours by gradation converter 17 and first diffusing circuit 19, as is a process to interpolate the gradation levels that are made discontinuous for stabilizing a discharge.

Here, in gradation converter 17, a target pixel is a pixel larger than a certain predetermined value, gradient, and also detected as a motion picture part, for an image signal having been input, and is a non-target pixel otherwise. For a target pixel, the gradation level of the target pixel is converted to a first gradation level, which is the average value of four gradation levels, for example, selected from the display-use gradation levels. Meanwhile, for a non-target pixel, the gradation level of the non-target pixel is converted to the display-use gradation level. Details for these are described later.

Further, first diffusing circuit 19 performs a first diffusion process, where a first gradation level having been output from gradation converter 17 is averaged spatially and/or chronologically using the above-mentioned four gradation levels. This is also described later.

An image signal having been output from first diffusing circuit 19 is input to image signal-subfield associating circuit 25, which converts the image signal to field information. The field information includes a plurality of bits to indicate whether each subfield is light-emitted (lighted) or not.

Subfield processor 27 determines the number of sustain pulses based on field information from image signal-subfield associating circuit 25.

Scanning-sustaining-erasing driver 29 and data driver 31 control the electrodes of PDP 33 according to the output from subfield processor 27, and control the amount of light emission of each pixel, to display desired gradations on PDP 33.

Figure 4:
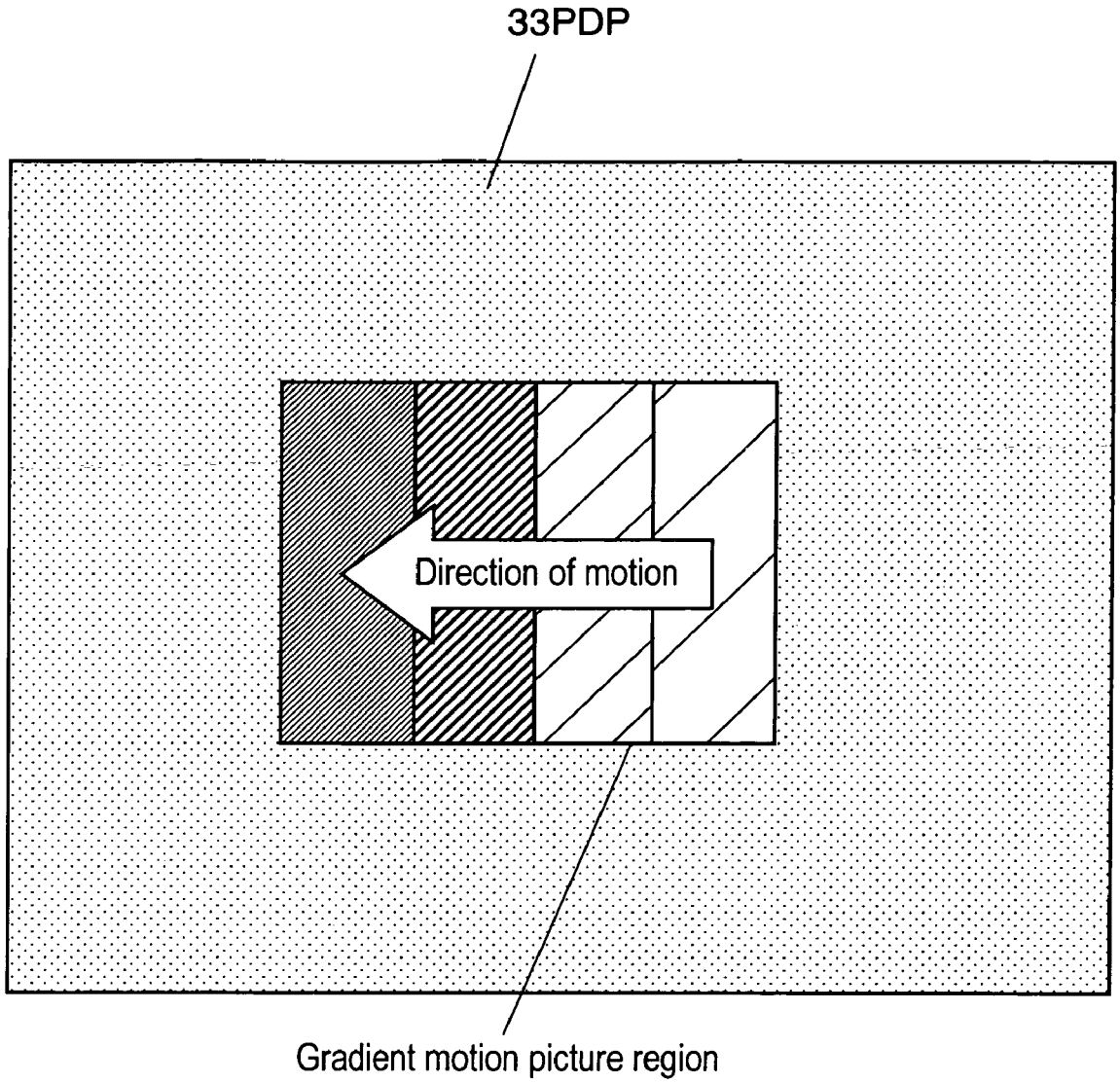
FIG. 4 illustrates how a gradient motion picture region horizontally moves on a PDP screen according to one embodiment of the present invention.

This situation is described using FIG. 3 and FIG. 4. FIG. 3 shows a part of FIG. 2A where gradation-levels 31 through 56 are extracted. FIG. 4 illustrates how a gradient motion picture region horizontally moves on the screen of PDP 33.

The dotted-line arrows in FIG. 3 show the motion of a sight line when a movement is visually traced where a gradient motion picture region in FIG. 4 moves in the direction indicated by the arrow in FIG. 4. When an image movement like the arrow in FIG. 4 is observed, for gradation levels in a range approximately "31" through "55" for example, dynamic false contours are observed although their occurrence position and extent vary according to the image movement. When an image motion as shown in FIG. 4 is traced visually, during a one-field period, a region appears where light emission is not observed as indicated by the dotted-line arrow shown in FIG. 3. Consequently, the region is observed as very dark dynamic false contours as compared with the levels of original luminance "31" through "55." In other words, as the sight line moves, an image that seems to be binary images to be displayed in each subfield slightly deviating and overlapping, is formed on the retina. At this moment, as shown in FIG. 3, non-emitted subfields (hereinafter abbreviated as "intermediate non-emitted subfield") with the maximum luminance weight, out of non-emitted subfields with a luminance weight smaller than the maximum luminance weight in the emitted subfields during a one-field period, overlap on the retina. Accordingly, extremely dark portions as compared with the surroundings are observed as dynamic false contours.

In such a way, dynamic false contours occur in a particular region determined by the gradation gradient and motion of an image, and also when gradation levels with adjacent subfields as "intermediate non-emitted subfields" intensively exist. For example, as shown in FIG. 3, The gradation level "40" has SF5 as its intermediate non-emitted subfield. The gradation level "48" has SF4 as its intermediate non-emitted subfield. That is, the gradation levels "40" and "48" have adjacent intermediate non-emitted subfields. In the same way, "40," "48," "52," "54," and "55" have adjacent intermediate non-emitted subfields. In a portion where the gradation is gradient, the gradation levels usually increase or decrease monotonously. When the motion of a portion with a gradient gradation is traced by a sight line, an image of overlapping intermediate non-emitted subfields is formed on the retina, and thus dynamic false-contours are observed. From all of these, in a region where the gradation is gradient and also moving, preventing gradations with adjacent intermediate non-emitted subfields from lying next to each other suppresses dynamic false contours.

In this embodiment, (n) (n is an integer of two or greater) levels of gradations are selected from among the display-use gradation levels, so that at least one level among the (n) levels has a different "intermediate non-emitted subfield," which is a non-emitted subfield, with the maximum luminance weight out of non-emitted subfields with a luminance weight smaller than the maximum luminance weight in the emitted subfields. In other words, the gradation level of a target pixel is converted to a first gradation level, which is an average value of the (n) levels of gradations selected from gradations whose "intermediate non-emitted subfields" do not lie next to each other, in the display-use gradations. Then, by a first diffusion process, in which the first gradation levels are averaged chronologically and/or spatially using (n) levels of display-use gradations, the first gradation levels are presented in a pseudo manner. This prevents gradation levels with adjacent intermediate non-emitted subfields from being arranged next to each other, and also dynamic false contours from being prominent.

In addition, in a position with a low gradation level of an image signal, because dynamic false contours are likely invisible, the gradation is displayed without the fore-mentioned process for diffusing intermediate non-emitted subfields being performed.

Gradation converter 17, having a look-up table (hereinafter abbreviated as "LUT"), converts gradation levels of pixels using this LUT. FIG. 5 shows a first LUT included in gradation converter 17, and FIG. 6 shows a second LUT included in gradation converter 17.

Gradation converter 17 switches an LUT to be used according to the output from motion detector 15 and gradient detector 37, and the gradation level of an input signal. A target pixel, which is a motion picture portion, gradient part, and also a portion where the gradation level of the input signal is higher than a predetermined gradation level, is converted to the first gradation level, which is an average value of four gradation levels out of the display-use gradation levels, by the first LUT shown in FIG. 5. The other non-target pixels are converted to the display-use gradations by the second LUT shown in FIG. 6. In this case, as a predetermined gradation level, a value of 50 or less is desirable when the sum of weights for all the subfields is 255. However, the size of a dynamic false contour is different depending on the number of subfields and weighting, and thus the optimum value is different among models of display apparatuses.

First diffusing circuit 19, which is a matrix adder for example, performs a first diffusion process, which is a predetermined diffusion process for the gradation levels having been output from gradation converter 17, based on the amount to be added shown in FIG. 5 and FIG. 6. The details are described later.

In the above case, the first gradation levels shown as a first LUT in FIG. 5 is created by averaging the four gradation levels alternately selected from the display-use gradation levels indicated as a second LUT in FIG. 6. For example, the gradation level "10" among first gradation levels (the first LUT) shown in FIG. 5 is the averaged value of "5," "7," "13," and "15" out of the display-use gradation levels (the second LUT) shown in FIG. 6. The reason for having selected alternately from the display-use gradation levels is to use as many gradation levels as possible at which intermediate non-emitted subfields do not lie next to each other. In such a way, in a first diffusion process after-mentioned, gradation levels with adjacent intermediate non-emitted subfields do not lie next to each other, and thus dynamic false contours can be suppressed.

Figure 7A:
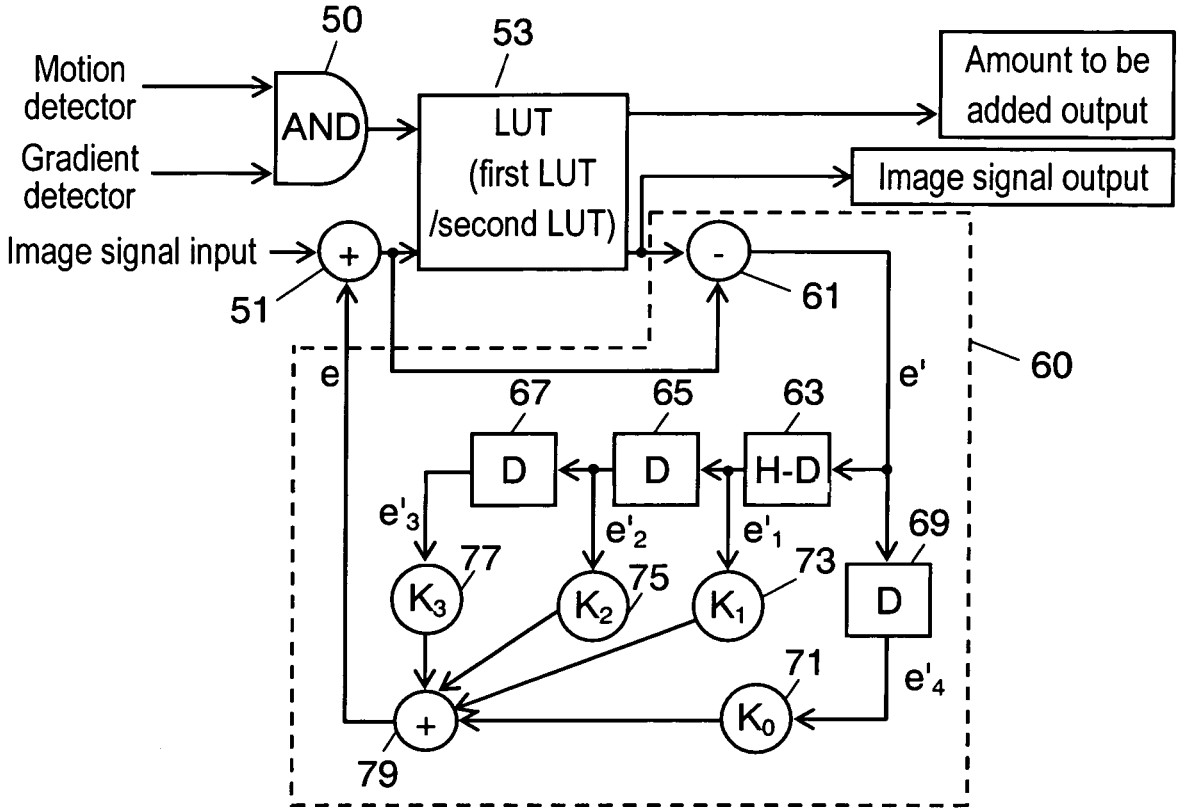
FIG. 7A is a block diagram for illustrating the gradation converter according to one embodiment of the present invention.
Figure 7B:
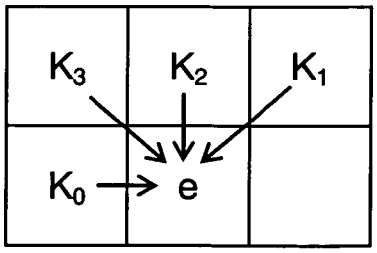
FIGS. 7B and 7C illustrate actions of the gradation converter according to one embodiment of the present invention.
Figure 7C:
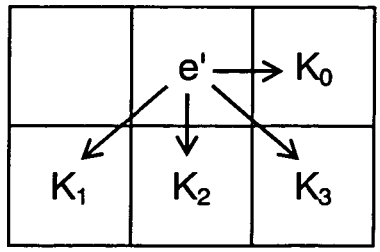
Figure 8:
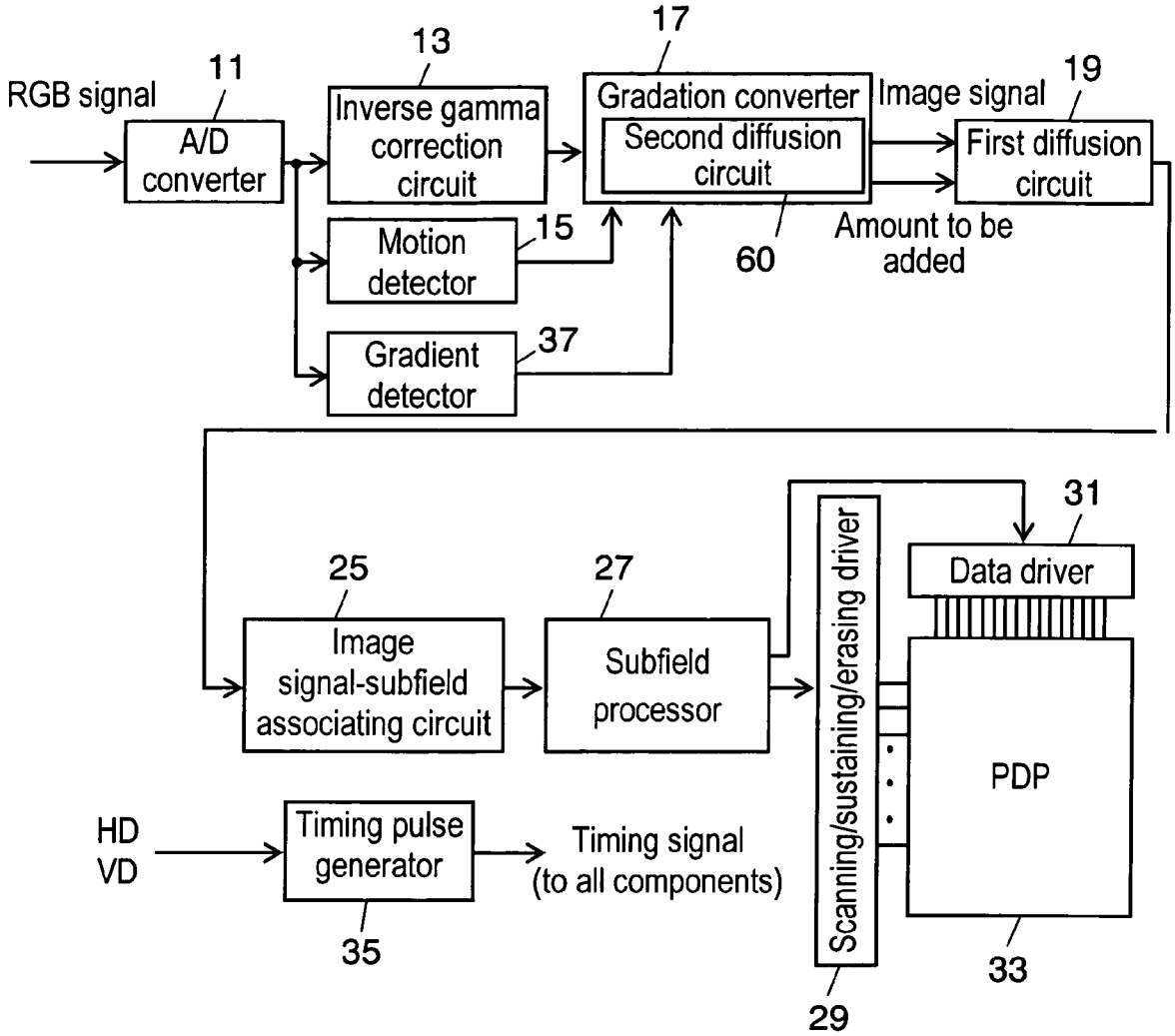
FIG. 8 is a schematic block diagram for illustrating the image display apparatus having a second diffusion circuit and adder 51 provided with the gradation converter according to one embodiment of the present invention.
Figure 10:
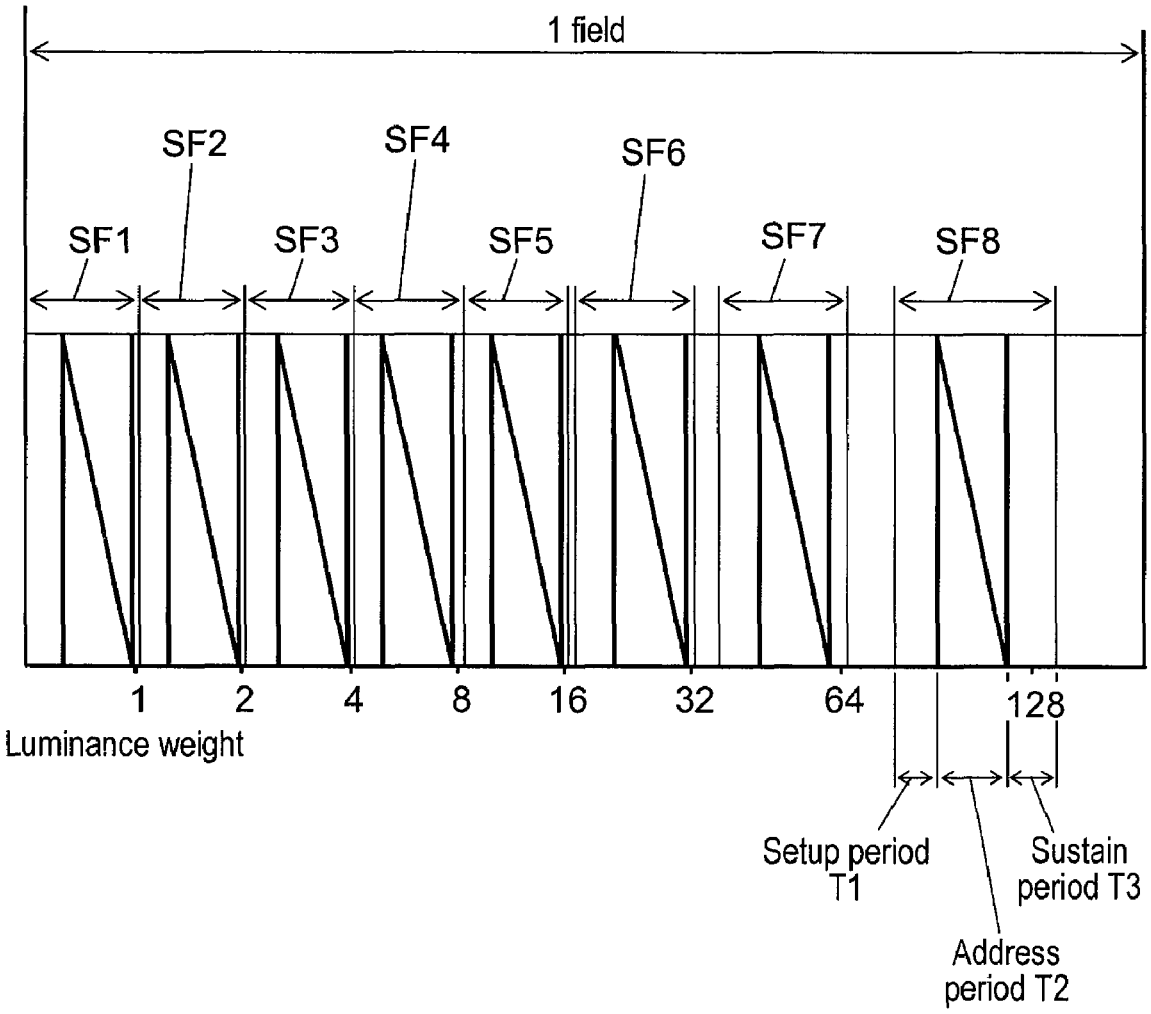
FIG. 10 PRIOR ART
FIG. 10 illustrates a single field divided into eight subfields.
Figure 11:
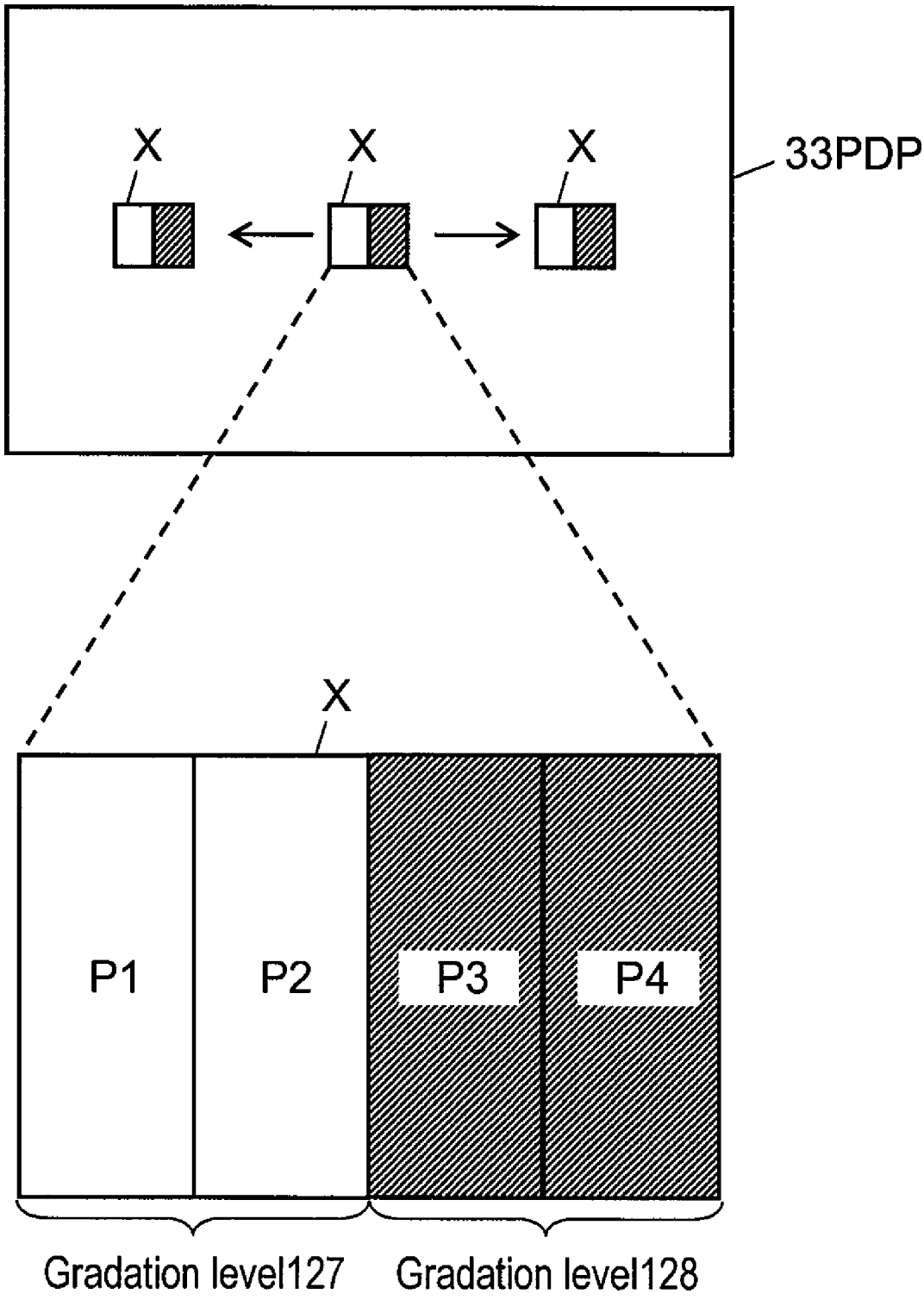
FIG. 11 PRIOR ART
FIG. 11 illustrates how image pattern X horizontally moves on the PDP screen.
Figure 12:
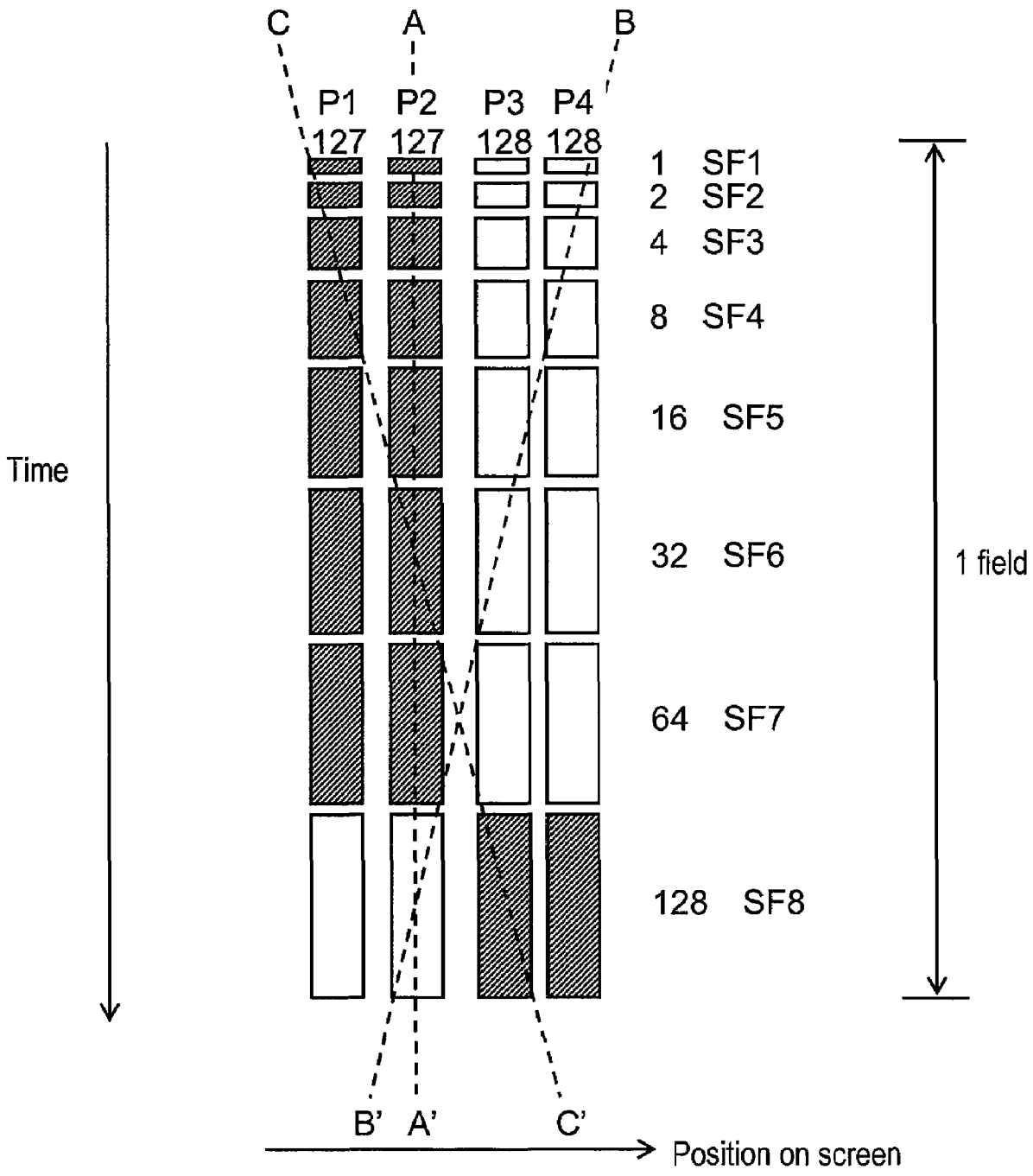
FIG. 12 PRIOR ART
FIG. 12 illustrates how image pattern X and a sight line move.

FIG. 7A is a schematic block diagram for illustrating gradation converter 17 according to the embodiment, and FIGS. 7B and 7C illustrate actions of gradation converter 17 according to the embodiment. Gradation converter 17 has AND gate 50 for performing an AND operation for the outputs from motion detector 15 and from gradient detector 37, and has LUT 53 including a first LUT and a second LUT. Gradation converter 17 may further have second diffusing circuit 60, which is an error diffusion process circuit for performing an error diffusion process, and adder 51. This reduces, if an image having been input is converted to a first gradation level or display-use gradation level, the number of gradation levels as compared to the number of gradation levels of the pre-converted image. Even in such a case, if the second diffusing circuit 60 and adder 51 are provided, a smooth, free from discontinuity in gradation, image can be displayed. FIG. 8 presents a schematic block diagram of an image display apparatus provided with second diffusing circuit 60 and adder 51 in gradation converter 17.

Next, actions of gradation converter 17 are described using FIGS. 7A, 7B, and 7C.

LUT 53 selects the first LUT for a target pixel, where the output from AND gate 50 is 1, namely the outputs from motion detector 15 and also from gradient detector 37 are 1, and select the second LUT for a non-target pixel, where the logical product is 0. Then, LUT 53 selects a gradation level nearest the pixel-original level from the first or second LUT, based on the gradation level of the pixel having been input from inverse gamma correction circuit 13, and output the level. In other words, the gradation level for the pixel is converted to the display-use gradation level for a non-target pixel, and to the first gradation for a target pixel.

When an image signal including gradation information for the pixel is input from inverse gamma correction circuit 13 to adder 51, the pixel-original gradation level based on the image signal is added to error e diffused from a pixel having been processed prior to the pixel in process, and the sum is output to LUT 53 and second diffusing circuit 60.

Second diffusing circuit 60, which is an error diffusion process circuit, calculates error e', which is the difference between the gradation levels before and after a conversion by LUT 53, and performs a second error diffusion process, where error e' is diffused to a pixel surrounding the pixel in process. Applying the second error diffusion process all over the screen maintains gradations to be displayed on the whole screen, resulting in a condition where the whole screen is viewed as if the original luminance of the pixels is displayed. Consequently, a high-quality, without roughness, image can be presented. In a makeup with second diffusing circuit 60 provided, the gradation level having been output from LUT 53 is output to second diffusing circuit 60 before being input to the first diffusing circuit 19.

Adder 51 adds an original gradation level of a pixel for an input image signal and a diffusion error e calculated by the second diffusing circuit 60 based on a gradation level of a pixel prior to the pixel in progress, and outputs to LUT 53 and second diffusing circuit 60.

Second diffusing circuit 60 acts as described below.

Second diffusing circuit 60 includes, as shown in FIG. 7A, subtracter 61; delay circuit 63, 65, 67, and 69; multiplier 71, 73, 75, and 77; and adder 79. Subtracter 61 subtracts a gradation level having been output from LUT 53 from a pixel-original gradation level with a diffusion error e added, and calculates error e', which is the difference therebetween. Error e' is input to delay circuits 63 and 69.

Delay circuit 63 outputs an input signal delayed by "one horizontal period minus one pixel." If one horizontal period (hereinafter abbreviated as "one line") represents 910 pixels for example, delay circuit 63 delays by 909 pixels. Delay circuits 65, 67, and 69 output input signals delaying by one pixel respectively. Therefore, delay circuit 63 outputs error e1', which is calculated for a pixel "one line minus one pixel" prior to a pixel currently being processed. Delay circuit 65 outputs error e2', which is calculated for a pixel "one line" prior to a pixel currently being processed. Delay circuit 67 outputs error e3', which is calculated for a pixel "one line plus one pixel" prior to a pixel currently being processed. Delay circuit 69 outputs error e4', which is calculated for a pixel "one pixel" prior to a pixel currently being processed.

Error e1' is multiplied by a predetermined coefficient k1 in multiplier 73. In the same way, errors e2', e3', and e4' are multiplied by predetermined coefficients k2, k3, and k0, in multipliers 75, 77, and 71, respectively, where respective coefficients k0, k1, k2, and k3 are appropriately determined so that the equation k0+k1+k2+k3=1 holds. After this, the outputs from respective multiplier 71, 73, 75, and 77 are totaled by adder 79, and the sum is output as diffusion error e for the pixel. In other words, second diffusing circuit 60 diffuses error e', which is the difference between a pixel-original gradation level with diffusion error e added, and a gradation level after converted by LUT 53, to surrounding pixels, with predetermined ratios k0 through k3, as shown in FIG. 7C. Diffusion error e for a certain pixel is achieved by totaling the errors diffused from the surrounding pixels as shown in FIG. 7B.

LUT 53 outputs four amounts to be added according to the respective gradation levels indicated by the first LUT in FIG. 5 or second LUT in FIG. 6. Here, the amounts to be added output from the second LUT are all zeroes.

As described above, gradation converter 17 adds diffusion error e to the gradation levels of the pixels for an input image signal, selects gradation levels appropriate to represent the gradation after the addition, and outputs the gradation levels, as well as the four amounts to be added for the gradation level. The image signals and the amount to be added from gradation converter 17 are input to first diffusing circuit 19.

Next, actions of first diffusing circuit 19 are described. In this embodiment, first diffusing circuit 19 performs a first diffusion process. The first diffusion process is a matrix addition process, where a matrix with k pixels by j lines (where k and j are positive integers holding k*j=n), composed of the difference values between the first gradation levels and (n) levels of gradations used to calculate the first gradation levels, is added to the image converted to the first gradation levels. Therefore, first diffusing circuit 19 includes a matrix adder, and diffuses the first gradation levels converted by gradation converter 17 in the first diffusion process, by predetermined amounts to be added to average them spatially and/or chronologically.

Specifically, a first gradation is presented in the following way.

FIGS. 9A and 9B show a matrix for a first diffusion process in first diffusing circuit 19. In this embodiment, as n=4, and thus k=2 and j=2. As shown in FIG. 9A, make a matrix with two pixels by two lines that has four amounts to be added d1 through d4 as the elements, having been output from LUT 53 along with the first gradation. Next, pave the matrices with two pixels by two lines as shown in FIG. 9B. Next the amount to be added positioned corresponding to the gradation levels for each pixel after the second diffusion process is added.

In this case, d1 through d4 are the differences between the first gradation levels and the display-use gradation levels used to create the first levels. Therefore, the sums of the first gradations with d1 through d4 added are display-use gradations, and thus their spatial average maintains the first gradations. Further, changing the positions of d1 through d4 for each field also averages chronologically, and thus the first gradations are maintained.

Image data obtained in such a way, even in a gradient part, gradation levels do not lie next to each other where intermediate non-emitted subfields are adjacent. Therefore, even a sight line follows a motion picture, intermediate non-emitted subfields do not overlap on the retina, and thus large dynamic false contours are not observed. For example, the gradation level "81" among the first gradations is represented by averaging four display-use gradation levels "65," "82," "88," and "90". The intermediate non-emitted subfield for the level "65" is SF6. Similarly, "82" is SF4, and "88⇆ is SF2. The level "90" does not have an intermediate non-emitted subfield, namely, in these four gradation levels, intermediate non-emitted subfields do not lie next to each other. Although the first gradation level "81" is diffused by the first diffusion process into these four gradation levels, because intermediate non-emitted subfields do not lie next to each other, large dynamic false contours do not occur even in a gradient region. Without the process according to the present invention being applied, although a gradation level near "81" is presented with either "74" or "82," which are display-use gradation levels, intermediate non-emitted subfields lie next to each other, resulting in large dynamic false contours occurring in a gradient region.

As described above, in this embodiment, large dynamic false contours can be suppressed due to gradation levels with adjacent "intermediate non-emitted subfields" lying next to each other in a gradient region.

In this embodiment, if a first gradation level is zero, all the amounts to be added are set to zeroes.

In addition, in this embodiment, although the number of subfields is set to 10, a display apparatus with an arbitrary number of subfields can also suppress dynamic false contours in the same way as in the present invention.

Further, in this embodiment, although a description is made for the sum of weights for all the subfields is 255, a display apparatus with arbitrary weights can also suppress dynamic false contours in the same way as in the present invention.

In addition, in this embodiment, although four gradation levels are selected from among the display-use gradation levels to create first gradation levels, it is not required to confine to "four," but an arbitrary number of gradation levels can be used.

Finally, in this embodiment, although the gradation levels shown in FIGS. 2A and 2B are used as "display-use gradation" levels, the present invention is not confined to this case, but converting once gradation levels having been input to a first gradation level created from the display-use gradation levels, and then to the display-use gradation level also suppresses dynamic false contours.

INDUSTRIAL APPLICABILITY

As described above, according to the present invention, an image display method and image display apparatus can be achieved to suppress dynamic false contours with sufficient gradation levels being sustained, even in a position where large dynamic false contours occur.

Reference Marks in the Drawings

11 A/D converter
13 Inverse gamma correction circuit
15 Motion detector
17 Gradation converter
19 First diffusion circuit
25 Image signal-subfield associating circuit
27 Subfield processor
29 Scanning/sustaining/erasing driver
31 Data driver
33 PDP
35 Timing pulse generator
37 Gradient detector
50 And gate
51 Adder
53 LUT
60 Second diffusion circuit
61 Subtracter
63, 65, 67, 69 Gradient detector
71, 73, 75, 77 Multiplier
79 Adder

The invention claimed is:

1. An image display method for displaying a gradation by a subfield method, wherein, a plurality of gradation levels are adopted as display-use gradation levels, each display-use gradation level including a non-emitted subfield having a luminance weight smaller than that of an emitted subfield having the maximum luminance weight, the non-emitted subfield not lying next to another non-emitted subfield within the respective display-use gradation level;

for a first display region in which a first image does not move or a gradation level thereof does not change monotonously, a gradation level to be displayed for the first display region is converted to a display-use gradation level for displaying first image;

for a second display region in which a second image moves and also a gradation level thereof changes monotonously, after a gradation level to be displayed for the second display region is converted to a first gradation level, which is an average of n (where n is an integer of two or greater) levels of display-use gradations selected from the plurality of display-use gradation levels, a first diffusion process, in which the first gradation level is averaged by using the n levels of display-use gradations spatially and/or chronologically, is performed for displaying the second image.

2. An image display method as claimed in claim 1, wherein at least one of the n levels of display-use gradations includes a different non-emitted subfield having the maximum luminance weight among non-emitted subfields having a luminance weight smaller than the maximum luminance weight in emitted subfields.

3. An image display method as claimed in claim 2, wherein the first diffusion process includes a matrix adding process, in which a matrix with k pixels by j lines (where k and j are positive integers holding k*j=n), having the differences between the n levels of gradations used for calculating the first gradation level, and the first gradation level, is added to an image converted to the first gradation.

4. An image display method as claimed in claim 3, wherein a second diffusion process, in which the gradation difference between before and after conversion of a gradation level of an arbitrary pixel in a display region, to the display-use gradation or the first gradation, is calculated, and then the difference is diffused to a pixel surrounding the pixel with a predetermined ratio, is performed.

5. An image display method as claimed in claim 1, wherein for m (m is an integer of two or greater) pixels continuously arranged horizontally or vertically, a case with gradation levels increasing or decreasing monotonously, is regarded as a display region in which the gradation levels change monotonously, and also the m pixels arranged continuously range between 3 mm and 15 mm inclusive in length or width on a display screen.

6. An image display method as claimed in claim 1, wherein for m (m is an integer of two or greater) pixels continuously arranged horizontally or vertically, a case with gradation levels increasing or decreasing monotonously, is regarded as a display region in which the gradation levels change monotonously, and also the m pixels arranged continuously range between 0.3% and 1.5% inclusive in breadth on a display screen.

7. An image display apparatus for displaying a gradation by a subfield method, comprising:

a gradation converter; wherein a plurality of gradation levels are adopted as display-use gradation levels, each display use gradation level including a non-emitted subfield having a luminance weight smaller than that of an emitted subfield having the maximum luminance weight, the non-emitted subfield not lying next to another non-emitted subfield within the respective display-use gradation, for a first display region in which first image does not move or gradation levels do not change monotonously, a gradation level to be displayed for the first display region is converted to a display-use gradation level for displaying the first image, and for a second display region in which second image moves and also gradation levels change monotonously, after a gradation level to be displayed for the second display region is converted to a first gradation level, which is an average of n (where n is an integer of two or greater) levels of display-use gradations selected from the plurality of display-use gradation levels; and a first diffusion circuit, in which the first gradation output from the gradation converter is averaged spatially and/or chronologically by using the n levels of display-use gradations.

8. An image display apparatus as claimed in claim 7, wherein at least one of the n levels of display-use gradations includes a different non-emitted subfield having the maximum luminance weight among non-emitted subfields having a luminance weight smaller than the maximum luminance weight in emitted subfields.

9. An image display apparatus as claimed in claim 8, wherein the first diffusion process includes a matrix adder for adding a matrix with k pixels by j lines (where k and j are positive integers holding k*j=n), having the differences between the n levels of gradations used for calculating the first gradation level, and the first gradation level, to an image converted to the first gradation level.

10. An image display apparatus as claimed in claim 8, further comprising a second diffusion circuit for calculating the gradation difference between before and after conversion of the gradation level of an arbitrary pixel in a display region, to the display-use gradation level or the first gradation level, and for diffusing the difference to a pixel surrounding the pixel with a predetermined ratio.

11. An image display apparatus as claimed in claim 7, wherein for m (m is an integer of two or greater) pixels continuously arranged horizontally or vertically, a case with gradation levels increasing or decreasing monotonously, is regarded as a display region in which the gradation levels change monotonously, and also the m pixels arranged continuously range between 3 mm and 15 mm inclusive in length or width on a display screen.

12. An image display apparatus as claimed in claim 7, wherein for m (m is an integer of two or greater) pixels continuously arranged horizontally or vertically, a case with gradation levels increasing or decreasing monotonously, is regarded as a display region in which the gradation levels change monotonously, and also the m pixels arranged continuously range between 0.3% and 1.5% inclusive in breadth on a display screen.

* * * * *

UNITED STATES PATENT AND TRADEMARK OFFICE

CERTIFICATE OF CORRECTION

PATENT NO. : 7,499,062 B2
APPLICATION NO. : 10/515526
DATED : March 3, 2009
INVENTOR(S) : Kazuhiro Yamada It is certified that error appears in the above-identified patent and that said Letters Patent is hereby corrected as shown below:

At Column 12, line 31, “which first image” should read --which a first image--

At Column 12, line 36, “which second image” should read --which a second image--

Signed and Sealed this

Twenty-eighth Day of July, 2009

John Doll

JOHN DOLL
*Acting Director of the United States Patent and Trademark Office*